US007913661B2

(12) United States Patent
Krempasky et al.

(10) Patent No.: US 7,913,661 B2
(45) Date of Patent: Mar. 29, 2011

(54) PROTECTIVE SYSTEM FOR A CRANK ANGLE SENSOR

(75) Inventors: Brad Krempasky, Marysville, OH (US); Tim Laakso, Marysville, OH (US); Brian Reynolds, Plain City, OH (US); Jeb Elsasser, Kenton, OH (US)

(73) Assignee: Honda Motor Co., Ltd., Tokyo (JP)

( * ) Notice: Subject to any disclaimer, the term of this patent is extended or adjusted under 35 U.S.C. 154(b) by 246 days.

(21) Appl. No.: 12/252,818

(22) Filed: Oct. 16, 2008

(65) Prior Publication Data

US 2010/0043733 A1 Feb. 25, 2010

Related U.S. Application Data

(60) Provisional application No. 60/980,600, filed on Oct. 17, 2007.

(51) Int. Cl.
*F02B 77/00* (2006.01)
*F02F 7/00* (2006.01)

(52) U.S. Cl. ..... 123/195 C

(58) Field of Classification Search ..... 123/195 C, 123/478, 476, 612, 414, 424, 631, 406.6; 73/116, 119 A, 117.2, 117.3; 324/208, 391; 364/559

See application file for complete search history.

(56) References Cited

U.S. PATENT DOCUMENTS

| | | | | |
|---|---|---|---|---|
| 3,996,914 | A * | 12/1976 | Crall et al. | 123/198 E |
| 5,186,131 | A | 2/1993 | Shinozawa et al. | |
| 6,598,573 | B2 | 7/2003 | Kobayashi | |
| 7,027,913 | B2 * | 4/2006 | Kobayashi et al. | 701/114 |
| 7,113,400 | B2 * | 9/2006 | Nagata et al. | 361/690 |

FOREIGN PATENT DOCUMENTS

| | | |
|---|---|---|
| JP | 4365973 | 12/1992 |
| JP | 08021242 | 1/1996 |
| JP | 08334043 | 12/1996 |
| JP | 2000073813 | 3/2000 |
| JP | 2005030311 | 2/2005 |
| JP | 2006184134 | 7/2006 |

* cited by examiner

*Primary Examiner* — Michael Cuff
*Assistant Examiner* — Keith Coleman
(74) *Attorney, Agent, or Firm* — Plumsea Law Group, LLC; Mark E. Duell

(57) ABSTRACT

A system for protecting a crank angle sensor is disclosed. The system includes a protective member, a heat insulating member and an airflow deflecting member. The heat insulating member insulates against heat from adjacent heat sources. The airflow deflecting member directs driving wind into an interior portion of the protective member to cool the air adjacent to a portion of the crank angle sensor. The protective member also includes holes to receive the driving wind directed from the airflow deflecting member.

20 Claims, 4 Drawing Sheets

PROTECTIVE SYSTEM FOR A CRANK ANGLE SENSOR

CROSS-REFERENCE TO RELATED APPLICATION

This application claims priority under 35 U.S.C. §119(e) to U.S. Provisional Patent Application No. 60/980,600, entitled "Protective System for a Crank Angle Sensor", and filed on Oct. 17, 2007, which application is hereby incorporated by reference.

BACKGROUND

The present invention relates to motor vehicles and in particular to a protective system for a crank angle sensor.

Devices related to a crank angle sensor have been previously disclosed. Tanaka et al. (Japanese patent number 2006-184134) is directed to a casing for a crank angle detecting device. Tanaka teaches a casing that is intended to inhibit water from penetrating into an internal space of the crank angle detecting device. Tanaka teaches a casing and an internal space that is opened to the atmosphere through a pressure buffering hole. The internal space houses a rotating member and a sensor. Air is received at the pressure buffering hole through a ventilation tube, having a portion extending downward in the vertical direction.

Tanaka teaches that whenever the temperature of the internal space falls rapidly, air will be inhaled at the ventilation tube in order to maintain a constant pressure within the internal space. Tanaka also teaches that any moisture in the air absorbed through the ventilation tube may gather within the tube and is thus prevented from entering the internal space through the pressure buffering hole. Tanaka also teaches a heat insulating coating that can be applied to an outer surface of the crank angle detecting device.

Dobashi (Japanese patent number 2005-30311) is directed to a vehicular internal combustion engine having a detector mounted on an engine block. Dobashi teaches a system for protecting a detector from bounced water or pebbles while a vehicle is traveling without increasing the number of parts.

Dobashi teaches a crank angle sensor mounted to an engine block. Dobashi also teaches a compressor mounted on a lower block and an oil pan via a bracket for an auxiliary engine. The crank angle sensor is mounted so as to be covered by the bracket that is interposed between the lower block and the compressor.

Nishio (Japanese patent number 8021242) is directed to a cooling piping structure for an engine. Nishio teaches a system that protects a crank angle sensor by cooling piping, in order to eliminate a need for a separate protection cover for the crank angle sensor. Also, Nishio teaches this system to prevent an increased number of parts and to reduce the cost. Nishio teaches a crank angle sensor disposed on a rear end of an engine. Also located at the rear end of the engine are a water outlet cap and an engine cooling water flow pipe. Nishio teaches that the cap and the pipe are disposed in such a manner to surround the crank angle sensor in the advancing direction of a vehicle. Additionally, the engine cooling water flow pipe is extended between the crank angle sensor and the exhaust manifold that is also attached to the engine.

The prior art lacks provisions for protecting the crank angle sensor from heat sources that may cause electrical components of the crank angle sensor to overheat. There is a need in the art for a solution to this problem.

SUMMARY

A system for protecting a crank angle sensor is disclosed. Generally, this system can be used in connection with an engine of a motor vehicle. The invention can be used in connection with a motor vehicle. The term "motor vehicle" as used throughout the specification and claims refers to any moving vehicle that is capable of carrying one or more human occupants and is powered by any form of energy. The term motor vehicle includes, but is not limited to cars, trucks, vans, minivans, SUVs, motorcycles, scooters, boats, personal watercraft and aircraft.

In some cases, the motor vehicle includes one or more engines. The term "engine" as used throughout the specification and claims refers to any device or machine that is capable of converting energy. In some cases, potential energy is converted to kinetic energy. For example, energy conversion can include a situation where the chemical potential energy of a fuel or fuel cell is converted into rotational kinetic energy or where electrical potential energy is converted into rotational kinetic energy. Engines can also include provisions for converting kinetic energy into potential energy, for example, some engines include regenerative braking systems where kinetic energy from a drivetrain is converted into potential energy. Engines can also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

In one aspect, the invention provides a motor vehicle, comprising: a sensor configured to measure a crank angle; a protective member configured to cover the sensor, the protective member including an interior portion and where a portion of the sensor is disposed within the interior portion; a heat insulating member substantially spaced from the protective member; and where the heat insulating member is disposed between the protective member and a heat source.

In another aspect, the invention provides a motor vehicle, comprising: a sensor configured to measure a crank angle; a protective member configured to cover a portion of the sensor, the protective member having an interior portion and where a portion of the sensor is disposed within the interior portion; an airflow deflecting member associated with the protective member; and where the airflow deflecting member is configured to direct air into the interior portion of the protective member and thereby cool the portion of the sensor disposed within the interior portion.

In another aspect, the invention provides a motor vehicle, comprising: a sensor configured to measure a crank angle; a protective member configured to cover a portion of the sensor, the protective member having an interior portion and where a portion of the sensor is disposed within the interior portion; an airflow deflecting member associated with the protective member; and at least one hole disposed on a portion of the protective member proximate to the airflow deflecting member and configured to receive air directed from the airflow deflecting member.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
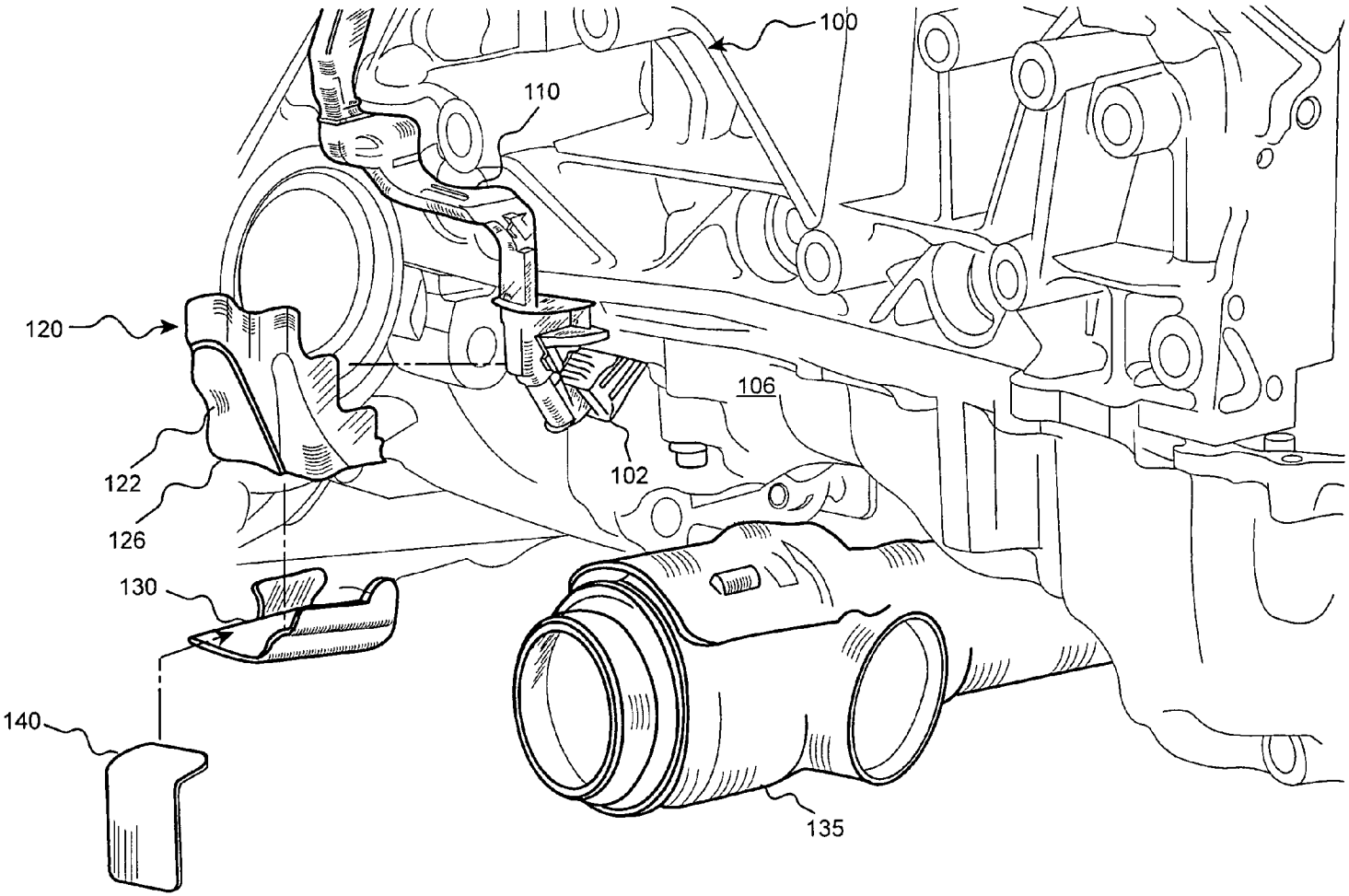
FIG. 1 is an exploded isometric view of an exemplary embodiment of a portion of an engine.
Figure 2:
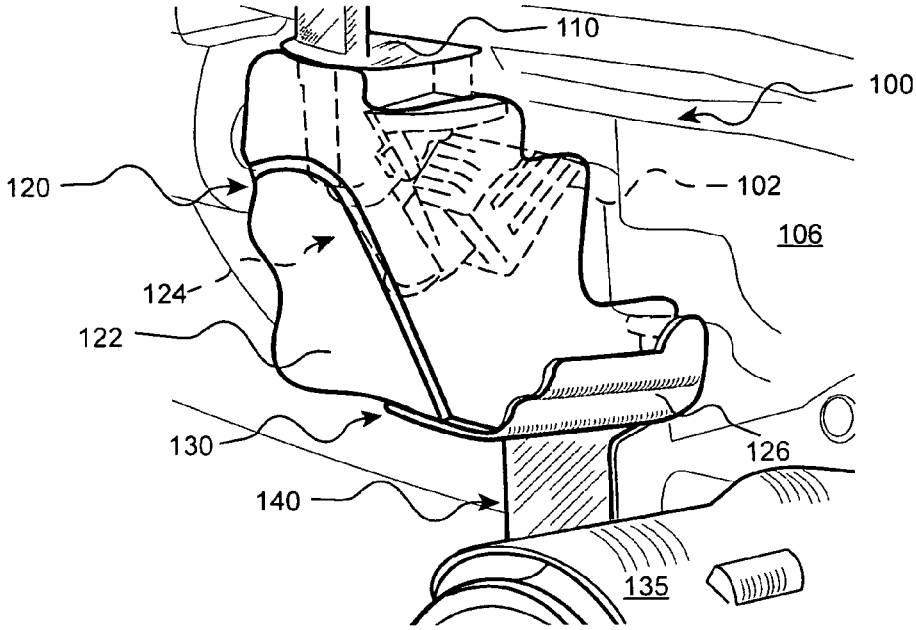
FIG. 2 is an assembled isometric view of an exemplary embodiment of a portion of an engine.

FIG. 1 is an exploded isometric view of an exemplary embodiment of a portion of engine 100. FIG. 2 is an assembled isometric view of an exemplary embodiment of a portion of engine 100. Referring to FIGS. 1 and 2, engine 100 may be associated with a motor vehicle of some kind. Generally, engine 100 could be associated with any type of motor vehicle, including, but not limited to cars, trucks, vans, minivans, SUV's, motorcycles, scooters, boats, personal watercraft and aircraft.

In some embodiments, an engine may include provisions for measuring the rotation of a crankshaft associated with an engine. In some embodiments, the engine may include a crank angle sensor that is configured to determine the current angular position of the crankshaft. In some cases, the crank angle sensor may be configured to provide information for fuel injection timing. In other cases, the crank angle sensor may provide information that is used to determine ignition timing. In still other cases, the crank angle sensor may be used to determine a current engine speed. In an exemplary embodiment, the crank angle sensor may be used to determine fuel injection timing, ignition timing and current engine RPMs.

In the current embodiment, engine 100 may include sensor 102. In some embodiments, sensor 102 may be a crank angle sensor. Generally, sensor 102 may be any type of crank angle sensor. In an exemplary embodiment, sensor 102 is associated with an electromagnetic pickup that is positioned near a rotary body configured to turn with the crankshaft. As the rotary body turns, sensor 102 may be configured to measure the angle of rotation of the crankshaft. Examples and further details of crank angle detectors have been previously disclosed in U.S. Pat. No. 6,058,766, the entirety of which is hereby incorporated by reference.

In some embodiments, sensor 102 may be disposed on lower portion 106 of engine 100. In some cases, sensor 102 may be associated with an oil pan of engine 100. In other embodiments, however, sensor 102 could be disposed on other portions of engine 100. Sensor 102 may be disposed proximate to a portion of the crankshaft.

Sensor 102 may be further associated with harness 110. In some embodiments, harness 110 may be configured to secure sensor 102 in place with respect to engine 100. Furthermore, in some embodiments, harness 110 may be configured to receive and protect one or more electrical wires that may connect sensor 102 with an electronic control unit or another electronic device. In this exemplary embodiment, harness 110 may wrap around a portion of engine 100 to help prevent any electrical wires associated with sensor 102 from protruding outward from engine 100.

Engine 100 may include provisions for protecting a sensor from pebbles, rocks or other debris that may cause damage to parts associated with an underside of an engine during movement. In some embodiments, the sensor may be associated with a protective member that is configured to partially cover the sensor. In an exemplary embodiment, the protective member may be a chipping cover that is configured to protect against rocks and other debris.

Referring to FIGS. 1 and 2, sensor 102 may be associated with protective member 120. Generally, protective member 120 has a shape that is configured to cover sensor 102 and that conforms generally to lower portion 106 of engine 100. In particular, protective member 120 may include generally convex outer portion 122 and interior portion 124 disposed opposite of convex outer portion 122. This shape allows protective member 120 to receive a portion of sensor 102, as illustrated in FIG. 2.

In some cases, air disposed within an interior portion of a protective member could be heated due to nearby heat sources. Examples of possible heat sources include portions of an exhaust system or portions of the engine block. In some embodiments, a protective member may include one or more provisions to prevent air disposed within the interior portion of the protective member from transferring excessive amounts of heat to the sensor. Such provisions are important since a portion of the sensor disposed within the interior portion may include one or more electrical components that may be adversely affected by excessive heat.

In some embodiments, the protective member may be associated with heat insulating provisions. In this embodiment, protective member 120 may be further associated with heat insulating member 130. Generally, heat insulating member 130 may be configured to associate with protective member 120 at lower portion 126 of protective member 120. With this arrangement, heat insulating member 130 may be disposed between protective member 120 and heat source 135 to prevent the transfer of heat from heat source 135 to protective member 120.

In the current embodiment, heat source 135 may be a portion of an exhaust system. For example, heat source 135 may be a portion of a pipe of the exhaust system. In other embodiments, however, heat source 135 could be another system associated with a motor vehicle that generates heat.

Because a crank angle sensor may be disposed near an oil pan portion of an engine, heat may be radiated directly from the engine as well. In some cases, the radiated heat may raise the temperature of the air disposed within an interior portion of a protective member configured to cover the sensor. Therefore, as the temperature of the air rises, the temperature of one or more electronic components associated with the sensor may also increase.

In some embodiments, a protective member may include provisions for cooling the air in the interior portion of the protective member. In some embodiments, the protective member may include provisions to circulate air through the interior portion. In an exemplary embodiment, the protective member may include provisions to receive driving wind created as a motor vehicle moves in the forward direction.

In this embodiment, protective member 120 may be associated with airflow deflecting member 140. Airflow deflecting member 140 may have a generally flattened shape. Additionally, airflow deflecting member 140 may be oriented in a generally vertical direction. In other words, airflow deflecting member 140 may be directed toward a driving surface.

Generally, members 120 and 140 may be made of any materials. In some embodiments, members 120 and 140 may be made of similar materials. In other embodiments, members 120 and 140 may be made of different materials. Members 120 and 140 may be made of substantially durable materials. In an exemplary embodiment, protective member 120 and airflow deflecting member 140 may each be made of a metallic material or metallic alloy.

Generally, heat insulating member 130 could be made of any material that is configured for thermal insulation. In some cases, heat insulating member 130 may be made of a metal or metallic alloy that has a low thermal conductivity. In other cases, heat insulating member 130 could be made of another thermally insulating material, including fibrous, cellular or granular materials. In an exemplary embodiment, heat insulating member 130 may be made of a thermally insulating metallic alloy that is rigid enough to withstand collisions with rocks, pebbles or other debris.

Protective member 120, heat insulating member 130 and airflow deflecting member 140 may be collectively referred to as a protective system. Using this protective system, a crank angle sensor can be protected from various types of damage, including physical damage and/or heat damage.

Figure 3:
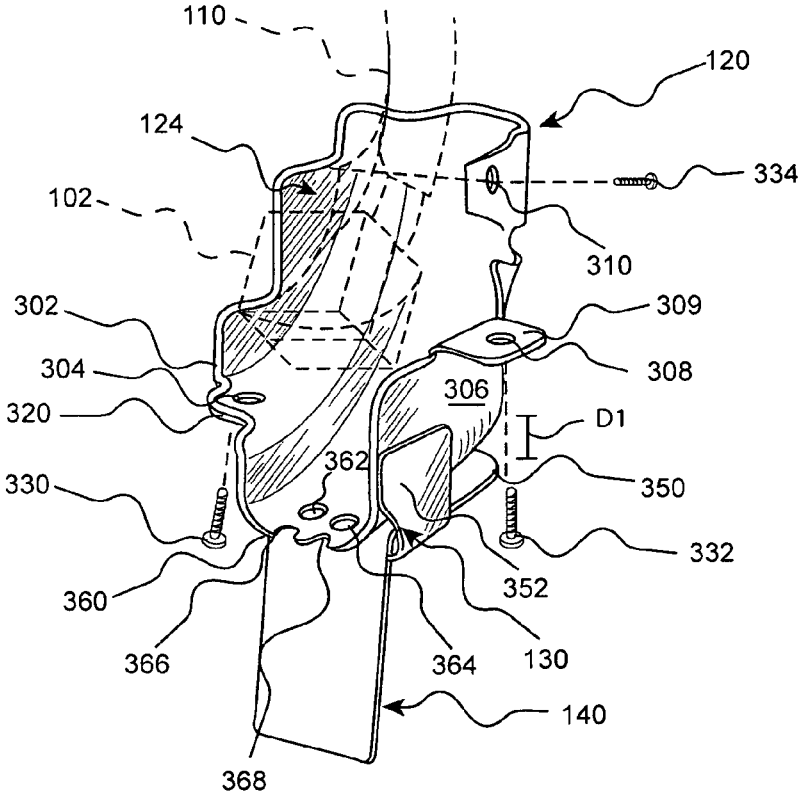
FIG. 3 is an exemplary embodiment of an assembly of a protective system for a crank angle sensor.
Figure 4:
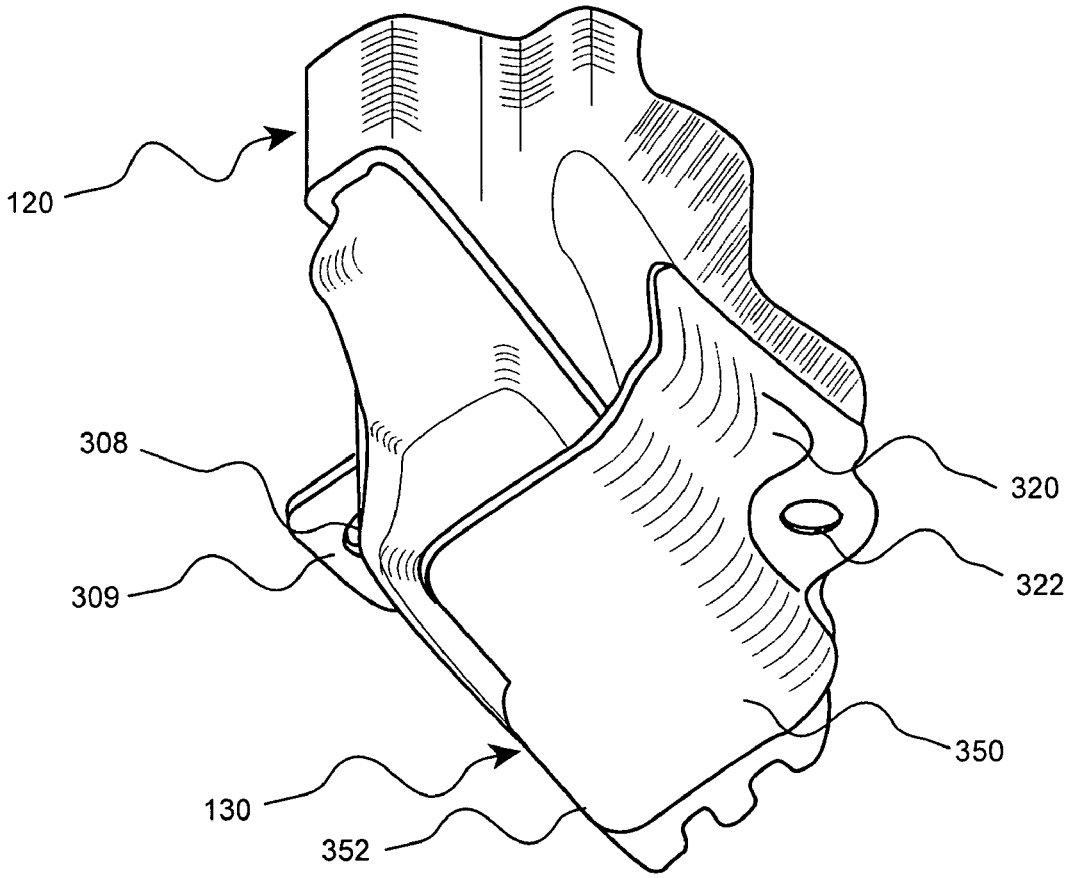
FIG. 4 is an exemplary embodiment of a heat insulating member and a portion of a protective member.

FIGS. 3 and 4 illustrate an exemplary embodiment of the assembly of members 120, 130 and 140. For purposes of clarity, portions of sensor 102 and harness 110 are shown in FIG. 3 in phantom. Referring to FIG. 3, protective member 120 may include provisions for associating with one or more components. In some cases, protective member 120 includes first side portion 302. In some embodiments, first side portion 302 includes first attachment hole 304. Protective member 120 may also include second side portion 306. In some embodiments, second side portion 306 includes second attachment hole 308. In some cases, second attachment hole 308 may be associated with tab 309. Finally, in some embodiments, second side portion 306 may also be associated with third attachment hole 310.

In an exemplary, first attachment hole 304 and second attachment hole 308 are configured to receive first bolt 330 and second bolt 332, respectively, that may be further inserted into a portion of engine 100 (see FIG. 2). Also, third attachment hole 310 may be a harness fixing hole that is configured to engage with harness 110 via screw 334. With this arrangement, protective member 120 may be bolted directly to engine 100 via bolts or other provisions at first attachment hole 304 and second attachment hole 308. Furthermore, in some cases, protective member 120 may be attached directly to harness 110 or sensor 102 using third attachment hole 310. This configuration allows sensor 102 to be fixed in place with respect to protective member 120.

Although the exemplary embodiment uses bolts to attach protective member 120 to a portion of an engine, in other embodiment different provisions may be used. For example, in some embodiments, an engine could be provided with a bracket that is configured to receive a protective member. In still other embodiments, a protective member could be partially welded to a portion of an engine. Generally any method for attaching a protective member to a portion of an engine that is known in the art may be used.

Referring to FIGS. 3 and 4, heat insulating member 130 may include provisions for attaching directly to protective member 120. For purposes of clarity, only heat insulating member 130 and protective member 120 are shown in FIG. 4. In this case, heat insulating member 130 includes mounting portion 320. Mounting portion 320 may include mounting hole 322. In an exemplary embodiment, mounting hole 322 is configured to associate with first attachment hole 304 or protective member 120. In particular, mounting hole 322 and first attachment hole 304 may be fastened together via first bolt 330. This arrangement allows heat insulating member 130 to be fastened securely in place with protective member 120 as protective member 120 is secured to a portion of engine 100.

In order to decrease thermal conductivity between heat insulating member 130 and protective member 120, heat insulating member 130 may be configured so that a majority of heat insulating member 130 does not directly contact protective member 120. Instead, as seen in FIGS. 3 and 4, heat insulating member 130 includes insulating portion 350 that is spaced away from lower portion 360 of protective member 120 by a distance D1. Additionally, insulating portion 350 is also disposed away from mounting portion 320 of heat insulating member 130. This arrangement may facilitate a small contact area between protective member 120 and heat insulating member 130 that helps to prevent heat from being conducted to protective member 120.

Generally, the separation distance between insulating portion 350 and lower portion 360 of protective member 120 may vary. In some cases, the separation distance D1 may vary between 1 millimeter and 10 millimeters. In other cases, the separation distance D1 may be greater than 10 millimeters. In still other embodiments, the separation distance D1 may be less than 1 millimeter.

In some embodiments, heat insulating member 130 may also include large tab portion 352. In some cases, large tab portion 352 may be configured to associate with second side portion 306. In other cases, large tab portion 352 may be spaced slightly apart from second side portion 306. This arrangement may help facilitate increased insulation from heat at second side portion 306.

In an exemplary embodiment, an airflow deflecting member includes provisions for associating with a protective member. In this embodiment, airflow deflecting member 140 may be disposed between lower portion 360 of protective member 120 and insulating portion 350 of heat insulating member 130. In some embodiments, airflow deflecting member 140 may be fused directly to protective member 120. In other embodiments, airflow deflecting member 140 could be fused directly to heat insulating member 130. Generally, airflow deflecting member 140 may be attached in any manner to protective member 120 and/or heat insulating member 130.

A protective member may include additional provisions for receiving air from an airflow deflecting member. In some embodiments, the protective member may include holes that are disposed proximate to the airflow deflecting member. In some cases, the protective member may include at least one hole. In other cases, the protective member may include at least one partial hole that is associated with an edge of the protective member. Generally, the protective member may be associated with any number of holes or partial holes. Additionally, the sizes of the holes and partial holes may vary.

Referring to FIG. 3, protective member 120 may include additional provisions for receiving air from airflow deflecting member 140. In some cases, protective member 120 may be provided with one or more holes. In this exemplary embodiment, protective member 120 may include first hole 362 and second hole 364 on lower portion 360 of protective member 120. Additionally, protective member 120 may include first partial hole 366 and second partial hole 368. Using this arrangement, as air travels up airflow deflecting member 140, the air may be transported through holes 362, 364, 366 and 368 into interior portion 124. In some embodiments, holes 362, 364, 366 and 368 have a size that prevents pebbles or other large debris from entering interior portion 124. In other embodiments, any or all of holes 362, 364, 366, and 368 may be excluded. Air may flow through protective member 120 regardless of the inclusion of holes 362, 364, 366, and 368, albeit through a smaller pathway around the edges of protective member 120. Therefore, holes 362, 364, 366, and 368 may be included to increase the amount and rate of airflow or eliminated to decrease the amount and rate of airflow.

Although the current embodiment includes provisions for holes at an edge of a lower portion of a protective member, in other embodiments, one or more holes could also be disposed at a central region of a lower portion of the protective member. With this alternative arrangement, hot air may be pulled out of the holes disposed at the central region as cool air is pulled in via the airflow deflecting member. Generally, one or more holes could be disposed at any region of the protective member to help facilitate the intake of cool air and the release of hot air.

Figure 5:
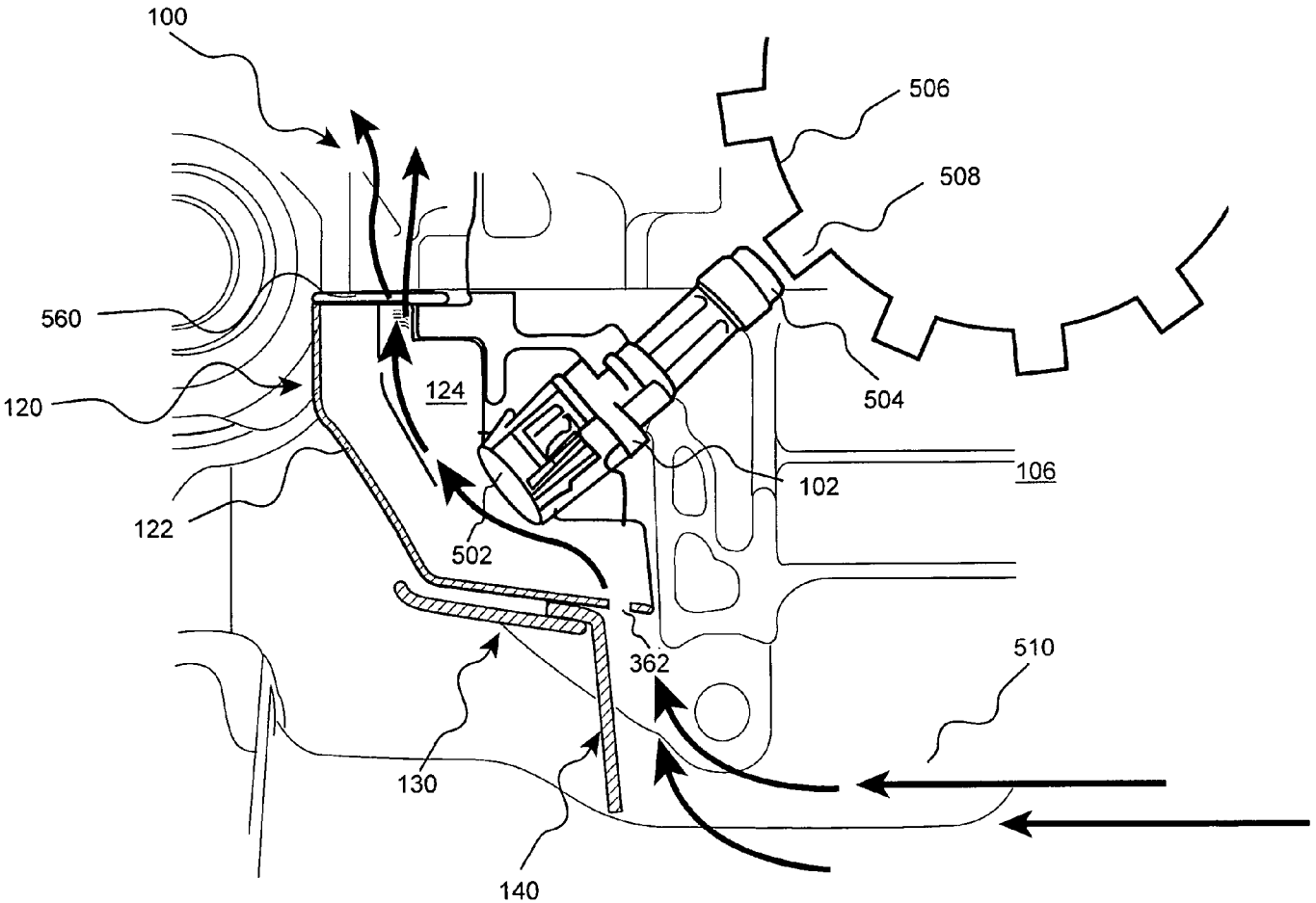
FIG. 5 is a side cross sectional view of an exemplary embodiment of a protective system for a crank angle sensor.

FIG. 5 is a side cross sectional view of an exemplary embodiment of members 120, 130 and 140 configured to protect and provide cooled air to sensor 102. In some embodiments, sensor 102 includes first end 502 that is disposed within interior portion 124. First end 502 may house one or more electronic components, such as a microprocessor, associated with sensor 102. Additionally, sensor 102 may include second end 504 that is disposed within engine 100. In this case, second end 504 is further associated with rotating member 506 that is attached to a crankshaft. With this arrangement, as rotating member 506 turns with the crankshaft, convex portions 508 associated with rotating member 506 are disposed proximally to second end 504 of sensor 102. In an exemplary embodiment, second end 504 includes an electromagnetic pickup that is configured to monitor the rotation of convex portions 508. This information can then be transmitted to an electrical component to determine the current angular position, or crank angle, of the crankshaft.

In this embodiment, as the motor vehicle moves in the forwards direction, incoming air 510 passes through the motor vehicle. Incoming air 510 generally moves from a front of the motor vehicle toward a rear of the motor vehicle. Generally, the lower surface of a vehicle is shaped to reduce wind drag, so that incoming air 510 flows beneath lower portion 106 of engine 100. Under normal circumstances, incoming air 510 would not contact sensor 102. However, the presence of airflow deflecting member 140 beneath engine 100 may help to redirect incoming air 510. In particular, incoming air 510 may flow upwards, in front of airflow deflecting member 140 and into interior portion 124 through various holes. In this cross sectional view, incoming air 510 is seen entering interior portion 124 through hole 362. Furthermore, as air is transported into interior portion 124, the pressure of additional air pushing up from airflow deflecting member 140 forces the air up and out of top portion 560 of protective member 120.

With this arrangement, air is constantly being pushed through interior portion 124. Therefore, the air disposed with interior portion 124 is constantly being circulated, and this helps to reduce the amount of heat that is transferred to sensor 102. The air disposed within interior portion 124 remains relatively cool and helps to prevent sensor 102 from overheating during operation.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A motor vehicle, comprising:

a sensor configured to measure a crank angle;

a protective member configured to cover the sensor, the protective member including an interior portion and wherein a portion of the sensor is disposed within the interior portion;

a heat insulating member substantially spaced from the protective member; and wherein the heat insulating member is disposed between the protective member and a heat source.

2. The motor vehicle according to claim 1, wherein the heat insulating member has a heat insulating portion and a mounting portion.

3. The motor vehicle according to claim 2, wherein the mounting portion is disposed away from the heat insulating portion.

4. The motor vehicle according to claim 3, wherein the mounting portion is attached to the protective member at a portion away from the heat source.

5. The motor vehicle according to claim 1, wherein the protective member is associated with an airflow deflecting member.

6. The motor vehicle according to claim 5, wherein the airflow deflecting member is configured to direct air into the interior portion.

7. A motor vehicle, comprising:

a sensor configured to measure a crank angle;

a protective member configured to cover a portion of the sensor, the protective member having an interior portion and wherein a portion of the sensor is disposed within the interior portion;

an airflow deflecting member associated with the protective member; and wherein the airflow deflecting member is configured to direct air into the interior portion of the protective member and thereby cool the portion of the sensor disposed within the interior portion.

8. The motor vehicle according to claim 7, wherein the airflow deflecting member is generally flat.

9. The motor vehicle according to claim 7, wherein the airflow deflecting member is oriented in a generally vertical direction.

10. The motor vehicle according to claim 7, wherein the protective member is associated with a heat insulating member.

11. The motor vehicle according to claim 10, wherein the heat insulating member is substantially spaced away from the protective member.

12. The motor vehicle according to claim 7, wherein the protective member includes at least one hole disposed proximate to the airflow deflecting member.

13. The motor vehicle according to claim 12, wherein the at least one hole is configured to receive air from the airflow deflecting member.

14. A motor vehicle, comprising:

a sensor configured to measure a crank angle;

a protective member configured to cover a portion of the sensor, the protective member having an interior portion and wherein a portion of the sensor is disposed within the interior portion;

an airflow deflecting member associated with the protective member; and at least one hole disposed on a portion of the protective member proximate to the airflow deflecting member and configured to receive air directed from the airflow deflecting member.

15. The motor vehicle according to claim 14, wherein the protective member includes two holes for receiving air.

16. The motor vehicle according to claim 15, wherein the protective member includes two partial holes for receiving air.

17. The motor vehicle according to claim 14, wherein the protective member includes more than two holes for receiving air.

18. The motor vehicle according to claim 14, wherein the protective member is associated with a heat insulating member.

19. The motor vehicle according to claim 18, wherein the heat insulating member is substantially spaced away from the protective member.

20. The motor vehicle according to claim 19, wherein the airflow deflecting member is integrally formed with the heat insulating member.

* * * * *